US005274854A

United States Patent [19]

Wenner et al.

[11] Patent Number: 5,274,854

[45] Date of Patent: Jan. 4, 1994

[54] ATHLETIC SUPPORT SHORT

[76] Inventors: Joyce A. Wenner, 851 Boulevard East #E2, Weehawken, N.J. 07087; Richard Wenner, 613 Walnut St., Freeland, Pa. 18224

[21] Appl. No.: 712,406

[22] Filed: Jun. 10, 1991

[51] Int. Cl.[5] ..... A41B 9/02

[52] U.S. Cl. ..... 2/403; 2/2; 2/400; 2/919

[58] Field of Search ..... 2/2, 784

[56] References Cited

U.S. PATENT DOCUMENTS

| | | | |
|---|---|---|---|
| 3,499,443 | 3/1970 | Scheerer | 128/159 |
| 3,787,892 | 1/1974 | Quinn | 2/2 |
| 3,788,314 | 1/1974 | Noreen | 2/2 |
| 3,909,847 | 10/1975 | Holt | 2/2 |
| 4,014,044 | 3/1977 | Figueroa | 2/2 |
| 4,035,844 | 7/1977 | Atack | 2/2 |
| 4,156,294 | 5/1979 | Horn | 2/400 |
| 4,389,733 | 6/1983 | Boykins | 2/2 |
| 4,660,554 | 4/1987 | Wright | 128/158 |
| 4,717,772 | 9/1984 | Miller | 2/403 |
| 4,870,958 | 10/1989 | Webster | 128/159 |
| 4,961,419 | 10/1990 | Tribble | 2/403 |
| 5,152,014 | 10/1992 | Marx | 2/78 B |

*Primary Examiner*—Clifford D. Crowder
*Assistant Examiner*—Diana L. Biefeld
*Attorney, Agent, or Firm*—Ronald P. Kananen

[57] ABSTRACT

An athletic support short is made of resilient, stretchable fabric and has an interior pouch extending between a waistband and the bottom of the crotch to receive a hard, protective cup. The pouch has an opening at its top and a releasable closure for retaining the cup. The top and bottom of the pouch are secured to the rest of the short, but the pouch is free of attachment to the rest of the short between the top and the bottom of the pouch.

12 Claims, 4 Drawing Sheets

ATHLETIC SUPPORT SHORT

BACKGROUND OF THE INVENTION

The present invention relates to athletic shorts for men and, more particularly, an athletic short which accommodates a hard protective cup and is suitable to be worn as outerwear as well as to be worn under other clothing or equipment.

Athletic supporters of resilient material, often called "jock straps", have long been known, and it is also well known to use a hard, protective cup in connection with such a supporter. Other clothing or equipment has been required over the supporter and cup, so that two or more layers of clothing or equipment have been needed.

Athletic garments are known which provide a releasably closeable pouch to receive a protective cup, such as U.S. Pat. No. 3,788,314 to Noreen which discloses such a pouch in a long leg garment for hockey players and football players. In the garment, the pouch is relatively short, only slightly greater than the height of a protective cup, and is shown attached to the remainder of the garment at the top and bottom, and along the sides. Accordingly, no movement between the pouch and the remainder of the garment is possible.

SUMMARY OF THE PRESENT INVENTION

By the present invention, an athletic support short is provided which accommodates a protective cup and is suitable to be worn on the exterior or under other clothing. The short is made of a resilient stretchable fabric, thus eliminating the need for a separate athletic supporter, as well as the need for layering shorts or other clothing on top of the constricting bands of an athletic supporter. An elongate pouch of stretchable material extends along the front interior of the athletic support short from the waistband, at the top of the pouch, to the bottom of the crotch, at the bottom of the pouch, the pouch being secured to the rest of the garment only at the top and the bottom of the pouch, whereby relative movement between most of the pouch and the rest of the garment is possible. An opening at the top of the pouch for insertion and removal of the removal cup is releasably closeable by mating vertical strips of Velcro. In an alternative embodiment, the Velcro strips at the top are eliminated in favor of horizontal Velcro strips extending across the interior of the pouch between the top and the bottom. The short has leg portions extending on the order of five to six inches below the crotch to provide protection against friction burns when the short is worn for activities involving contact with the ground.

DETAILED DESCRIPTION OF THE PREFERRED EMBODIMENT

Figure 1:
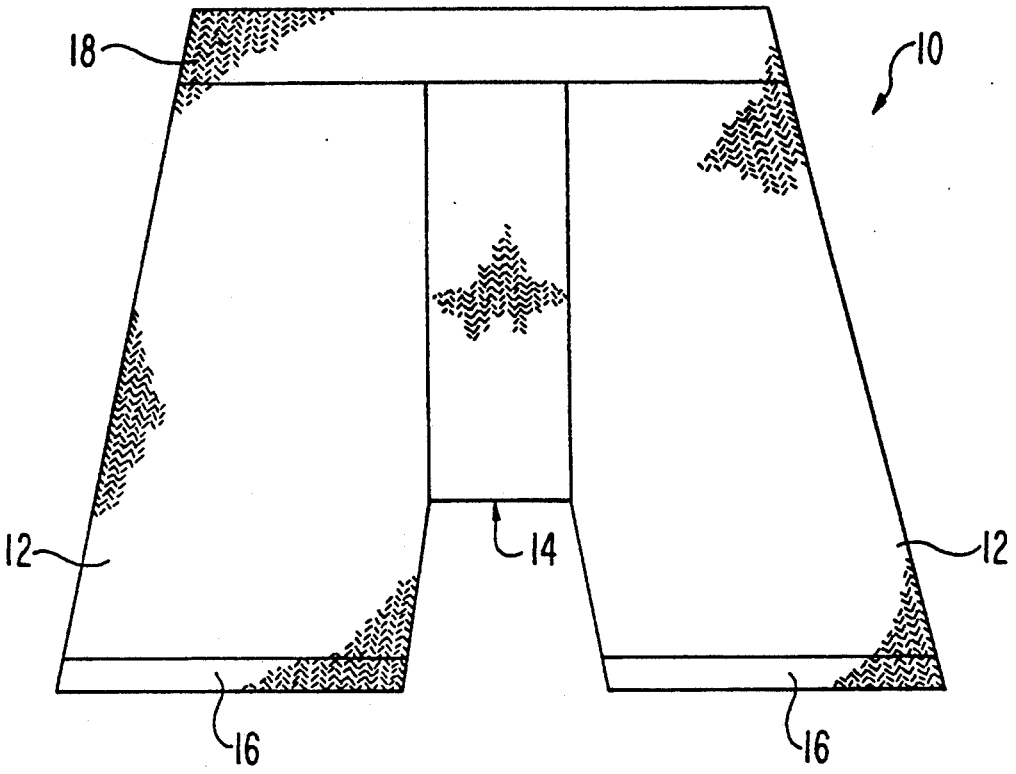
FIG. 1 is a front exterior view of the athletic support short according to the present invention.
Figure 2:
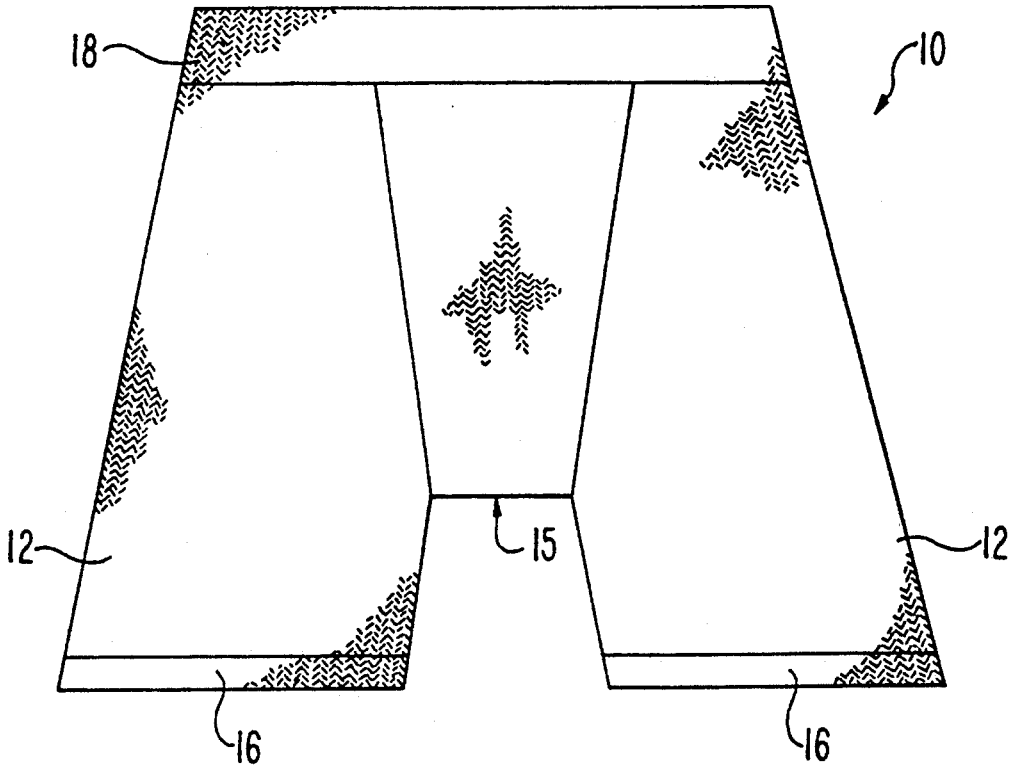
FIG. 2 is a rear exterior view of the short of FIG. 1.

As can be seen from FIGS. 1 and 2, the athletic support short according to the present invention, which is designated generally by the reference numeral 10, includes panels of fabric defining first and second legs 12 joined together by a front crotch panel 14 and a rear crotch panel 15. The legs 12 extend below the crotch by a distance on the order of five to six inches. The legs 12 are hemmed at 16, and a waistband portion 18 containing an elastic band (not shown) is attached at the top of the leg panels 12 and crotch panels 14 and 15. The elastic band is made of a material producing greater resilient force per unit area than the material of the rest of the athletic support short. The entire athletic short 10, with the exception of the elastic band is made of a resilient stretch fabric, such as a 12 ounce cotton and spandex mixture. The fabric is chosen to stretch at least 10 percent, and the fabric can stretch that much if it has a content of at least 8 percent spandex (sold under the trademark LYCRA). Although a 12 ounce cotton and spandex mixture has been mentioned, a lighter or heavier weight fabric containing LYCRA brand stretchable material and either cotton or nylon is suitable.

Figure 3:
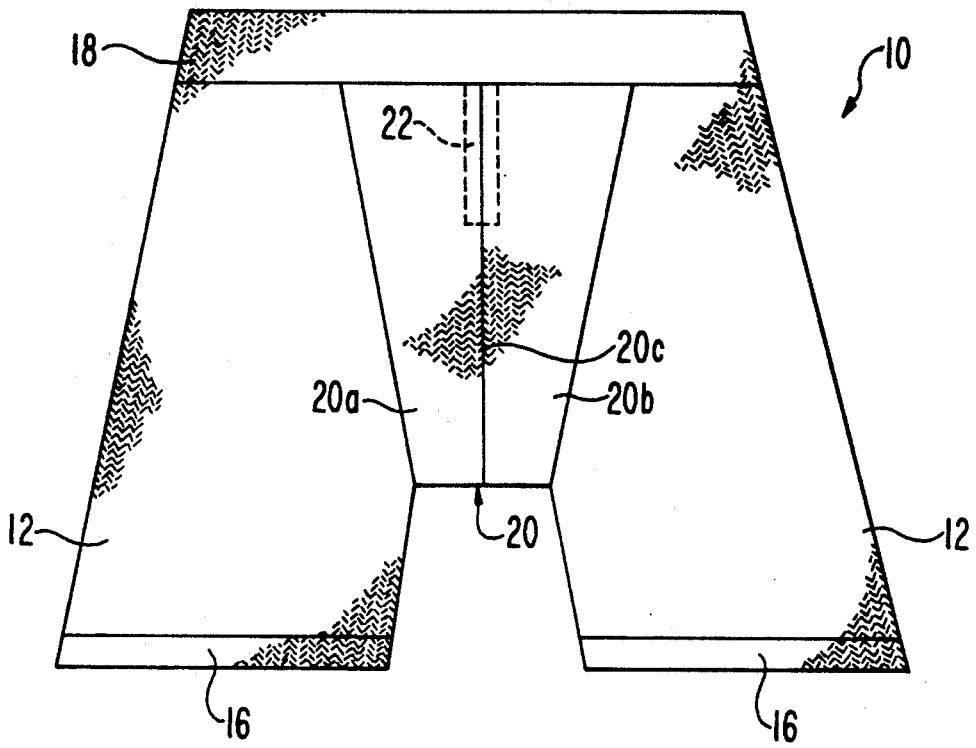
FIG. 3 is a view of the front interior of the athletic short of FIG. 1, the short having been turned inside out.
Figure 4:
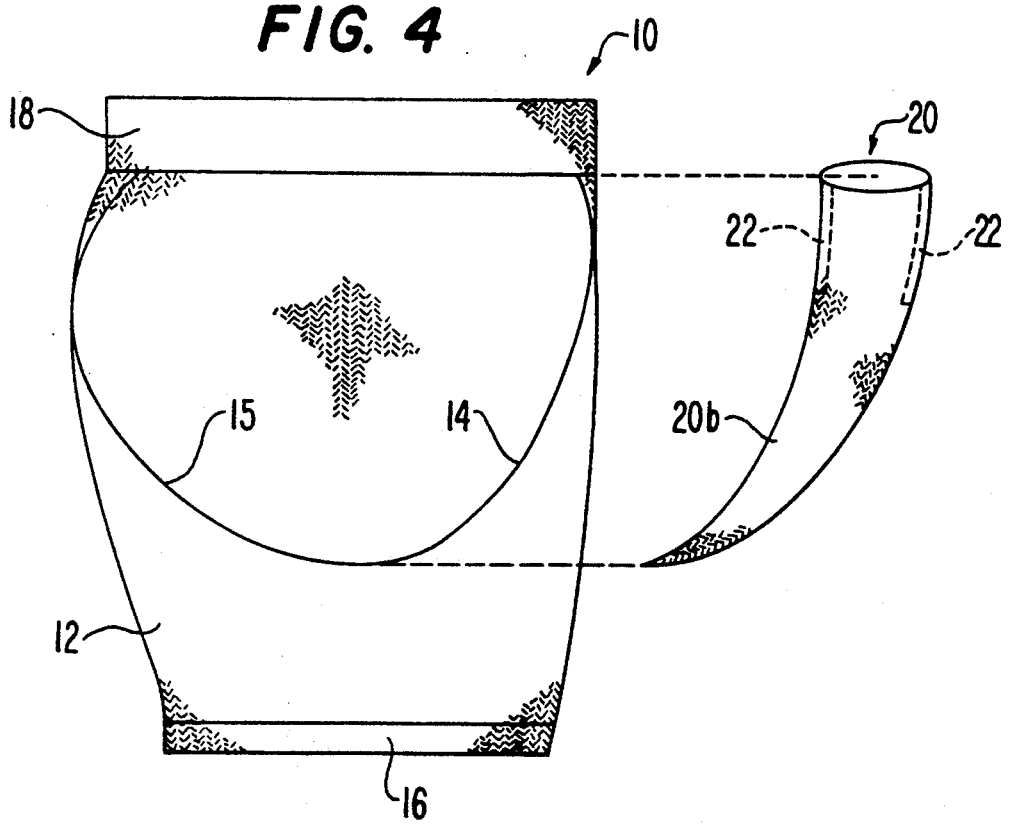
FIG. 4 is a left side cross section of the short of FIG. 1, with a pouch for a protective cup exploded out of position.
Figure 5:
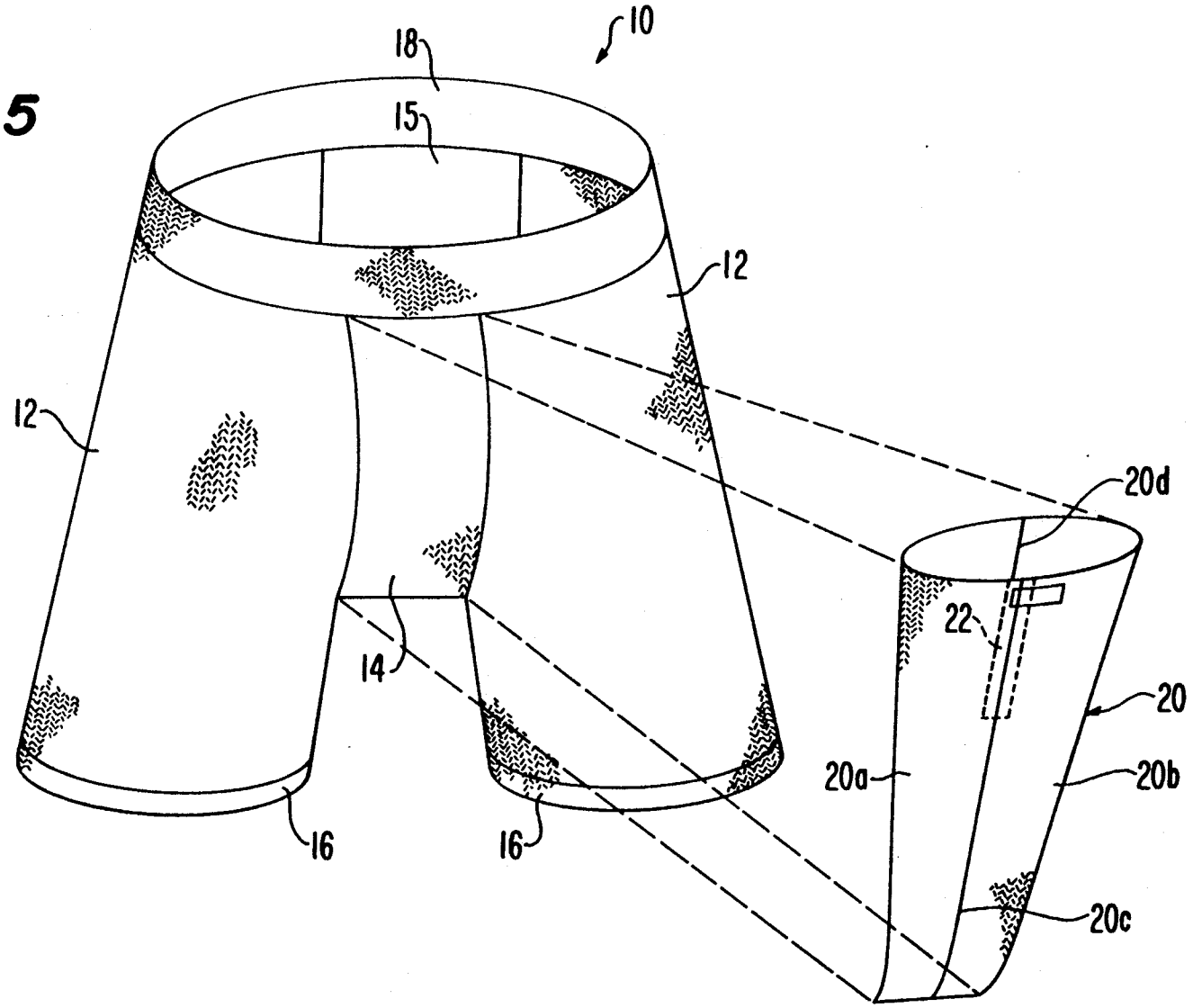
FIG. 5 is a perspective view of the short of FIG. 1 in an inside-out condition with the interior exposed and the pouch exploded.

As can be seen from the inside-out view of FIG. 3, the cross-section of FIG. 4, and the perspective view of FIG. 5, a pouch 20 having a frustoconical shape is attached to the athletic support short 10 adjacent to the interior of the front crotch panel 14. The bottom of the pouch 20 is attached at the bottom of the crotch, such as by being sewn to a seam between the front and rear crotch panels 14 and 15. The top of the pouch 20 is attached at the bottom of the interior of the waistband portion 18 at the top of the interior of the front crotch panel 14 and portions of the interiors of the leg panels 12, such as by sewing. Although the bottom of the pouch 20 may be sewn shut, the top of the pouch 20 is left open and a releasable closure is provided so that a protective cup can be inserted in the pouch and the closure can be secured, whereby the protective cup is retained in the pouch. Mating strips of a fabric hook-and-loop type fastener, such as that sold under the trademark VELCRO, are preferred for use as the fastener 22. Preferably, strips on the order of 1 inch wide and 2 ¾ inches long are oriented vertically, extending from the waistband portion 18 toward the bottom of the crotch. One of the fastener strips is secured to the center of the interior of a front portion of the pouch 20, and the other strip is secured to a facing interior portion on the rear of the pouch. The pouch 20 is preferably made of the same material as the rest of the athletic support short 10. The pouch 20 is made from two pieces of material **20*a* and 20*b* which are sewn together along a seam 20*c* at the rear of the pouch and a similar seam (not shown) at the front of the pouch. In FIG. 3, the pouch 20 is shown flattened against the front crotch panel 14, and in FIG. 4**, the pouch is shown in a fully open position.

Figure 6:
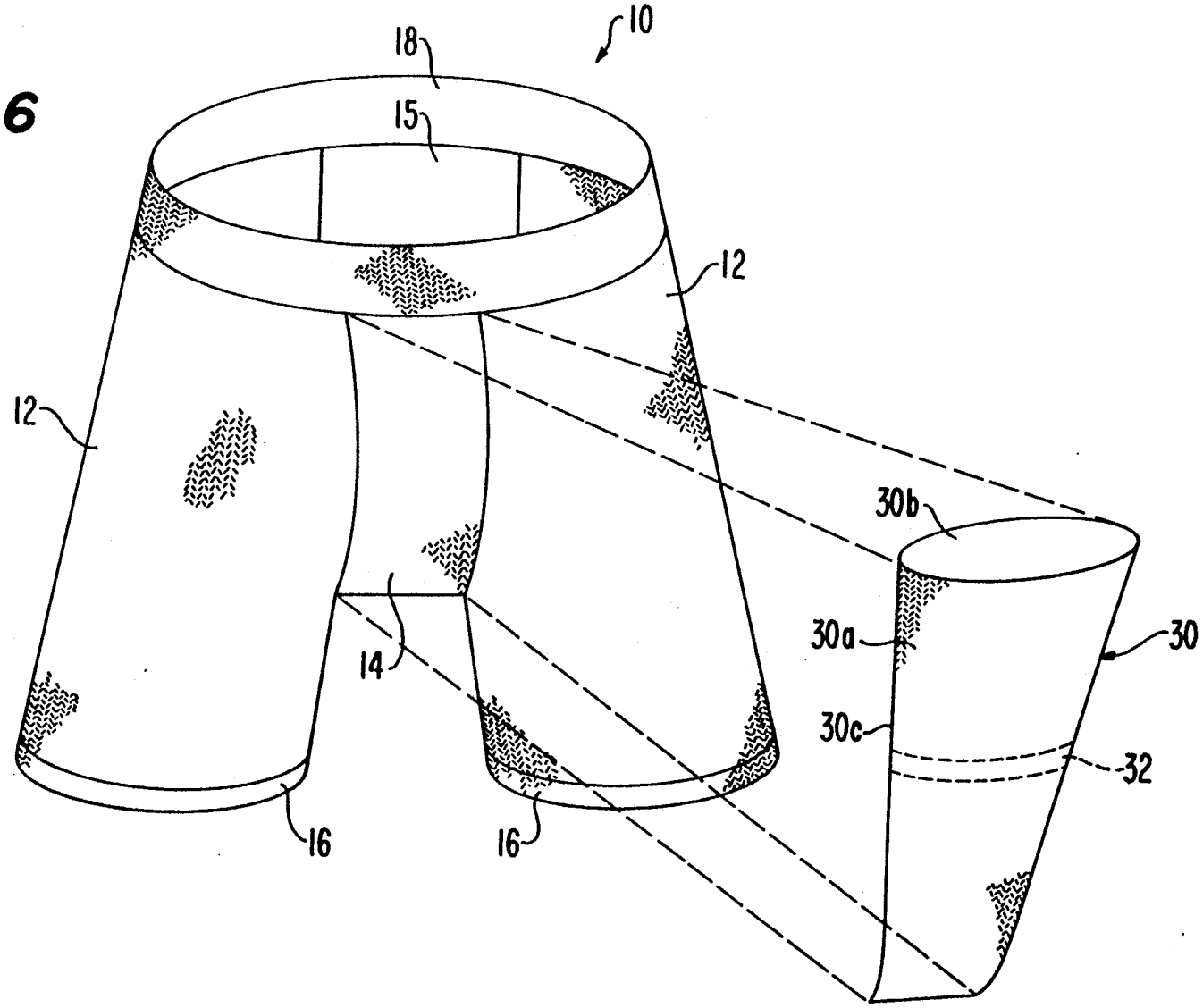
FIG. 6 is a perspective view of an alternate embodiment of short according to the present invention in an inside-out condition with the interior exposed and the pouch exploded.

As can be seen from FIG. 6, in an alternate pouch construction, the pouch, which is designated by the reference numeral 30, is made from a front piece of material **30*a* and a rear piece of material 30*b* which are sewn together along one seam 30*c* along one side of the pouch and a similar seam (not shown) along the opposite side of the pouch. The releasable fastener is omitted from the opening at the top of the pouch 30. Instead, a fastener 32, such as Velcro strips extending horizontally along the interior of the pouch 30, is positioned below the opening of the pouch. By this arrangement, the strips defining the fastener 32 can be separated, a hard, protective cup inserted, and the strips refastened. The cup is then retained by the mating strips of the fastener 32** in a lower portion of the pouch where it is intended to be positioned.

It will be understood that various modifications can be made to the above-described preferred embodiments without departing from the spirit and scope of the invention. Furthermore, as will be seen from the embodiments shown in the drawings, the previously described advantages may be readily and economically attained by the structure of the present invention. For example, the front and rear crotch panels 14 and 15 can be eliminated from any of the embodiments and the leg panels 12 extended laterally to meet at a center seam extending from the front of the waistband portion 18, down the front of the support short 10, underneath along the crotch, and up the rear to the rear of the waistband portion 18. Thus, such a garment would have a conventional center seam, as used in most pants, and, although not having separate crotch panels, would still define leg portions and a crotch portion.

I claim:

1. An athletic support sort suitable for wear as both an exterior garment and an under garment for men, the short defining an interior having a front, comprising:

a body including leg portions and a crotch portion, all of said portions being made of stretchable resilient material and sized to stretch when worn by an intended wearer, said stretchable material being a cotton-spandex having at least 8 percent spandex, a pouch for a protective cup secured in the interior of the short at the front of the interior, said pouch having a front, a rear, and an opening to allow insertion and removal of a protective cup;

wherein said pouch has a top and a bottom, said pouch being secured to the body of the athletic support short at the top of the pouch and at the bottom of the pouch and being free of attachment to the body of the athletic support short between the top and bottom of the pouch, whereby a portion of the pouch between said top and said bottom of said pouch is movable relative to the body of said athletic support short; and means for releasably holding together said front of the pouch and said rear of the pouch to retain the cup in position, whereby said support short provides resilient athletic support for the wearer.

2. The athletic support short of claim 1, further comprising a waistband portion.

3. The athletic support short of claim 1, wherein said pouch has a top and a bottom, and said means for releasably holding together said opposite sides of the pouch comprises a fastener positioned between the bottom and the top of the pouch.

4. The athletic support short of claim 3, wherein said fastener comprises first and second mating strips of a fabric hook-and-loop fastener secured to interior surfaces of the front and the rear of the pouch, each said strip defining a length oriented horizontally in said pouch.

5. An athletic support short suitable for wear as both an exterior garment and an under garment for men, the short defining an interior having a front, comprising:

a body including leg portions and a crotch portion, all of said portions being made of stretchable resilient material and sized to stretch when worn by an intended wearer;

a pouch for a protective cup secured in the interior of the short at the front of the interior, said pouch having a top, a bottom, a front, a rear, and an opening to allow insertion and removal of a protective cup, said pouch being secured to the body of the athletic support short at the top of the pouch and at the bottom of the pouch and being free of attachment to the body of the athletic support short between the top and bottom of the pouch, whereby a portion of the pouch between said top and said bottom of said pouch is movable relative to the body of said athletic support short;

means for releasably holding together said front and said rear of the pouch to retain the cup in position; and a waistband portion, the top of said pouch being secured to the body of the athletic support short at the waistband portion, said pouch opening being at the top of said pouch, whereby said support short provides resilient athletic support for the wearer.

6. The athletic support short of claim 5, wherein said cotton-spandex material is 12 ounce cotton-spandex material.

7. The athletic support short of claim 5, wherein said means for releasably holding together said front of said pouch and said rear of said pouch comprises means for releasably closing the pouch opening.

8. The athletic support short of claim 7, wherein said means for releasably closing the pouch opening comprises first and second mating strips of a fabric hook-and-loop fastener secured to interior surfaces of said pouch adjacent to said pouch opening, each said strip defining a length oriented vertically in said pouch.

9. The athletic support short of claim 5, wherein said leg portions extend below said crotch portion.

10. The athletic support short of claim 5, wherein said crotch has a bottom, and the bottom of said pouch is secured to the bottom of said crotch portion.

11. The athletic support short of claim 5, wherein said stretchable material is a cotton-spandex material having at least 8 percent spandex.

12. An athletic support short suitable for wear as both an exterior garment and an under garment for men, the short defining an interior having a front, comprising:

a body including leg portions and a crotch portion, all of said portions being made of stretchable resilient material and sized to stretch when worn by an intended wearer;

a pouch for a protective cup secured in the interior of the short at the front of the interior, said pouch having a top, a bottom, a front, a rear, and an opening to allow insertion and removal of a protective cup, said pouch being secured to the body of the athletic support short at the top of the pouch and at the bottom of the pouch and being free of attachment to the body of the athletic support short between the top and bottom of the pouch, whereby a portion of the pouch between said top and said bottom of said pouch is removably relative to the body of said athletic support short; and means for releasably holding together said front and said rear of the pouch to retain the cup in position.

* * * * *